US006004172A

United States Patent [19]

Kerek

[11] Patent Number: 6,004,172

[45] Date of Patent: Dec. 21, 1999

[54] TWO PIECE PIN/SOCKET CONTACT

[75] Inventor: Leslie Laszlo Kerek, Los Angeles, Calif.

[73] Assignee: Tri-Star Electronics International, Inc., El Segundo, Calif.

[21] Appl. No.: 09/053,560

[22] Filed: Apr. 1, 1998

[51] Int. Cl.[6] ..... H01R 9/24

[52] U.S. Cl. ..... 439/891; 439/879

[58] Field of Search ..... 439/891, 879, 439/825

[56] References Cited

U.S. PATENT DOCUMENTS

| | | | |
|---|---|---|---|
| 3,149,899 | 9/1964 | Johanson . | |
| 3,210,720 | 10/1965 | Harris, Jr. . | |
| 3,569,918 | 3/1971 | Arnold . | |
| 3,832,498 | 8/1974 | Lawson . | |
| 4,031,614 | 6/1977 | Gipe | 439/891 |
| 4,090,771 | 5/1978 | Moulin . | |
| 4,405,195 | 9/1983 | Cherry et al. | 439/825 |
| 4,812,129 | 3/1989 | Rofer et al. | 439/891 |
| 5,106,328 | 4/1992 | Prochaska et al. . | |
| 5,199,911 | 4/1993 | Dowart, Jr. et al. . | |
| 5,387,138 | 2/1995 | O'Malley . | |
| 5,399,110 | 3/1995 | Morello et al. . | |
| 5,439,391 | 8/1995 | McEtchin et al. . | |
| 5,492,489 | 2/1996 | Chavakula . | |

*Primary Examiner*—Michael L. Gellner
*Assistant Examiner*—Antoine Ngandjui
*Attorney, Agent, or Firm*—Harold L. Jackson

[57] ABSTRACT

A pin/socket contact is made from two contact parts, namely, a pin/socket member and a tail/coupling member. The pin/socket member has a blind bore therein for receiving a stub portion on the tail/coupling member. Burrs on the stub portion hold the tail/coupling and pin/socket members together. The pin/socket member can be standardized and inventoried in large quantities to be assembled to a variety of tail/coupling members in which the tail portion is in the form of a PC tail, wire wrap adaptor or a compliant adapter.

26 Claims, 4 Drawing Sheets

41
43
37
37a
37a
39
14

43
39
14

14
42'
60'
12'

14
48
44'
48
50
60
12'

58
56
48
54
52
48
50
62
60
20'
12'

14'
42'
40'
44'

TWO PIECE PIN/SOCKET CONTACT

FIELD OF THE INVENTION

This invention relates generally to a male or female terminal arrangement, and more particularly, it is directed to a two piece pin/socket contact and method for making the same.

BACKGROUND OF THE INVENTION

Electronic devices have become commonplace in most equipment on the ground from automobiles to telecommunications equipment as well as equipment in the air such as planes, missiles and satellites. Society has become accustomed to more innovative consumer products year after year, such as televisions, cell phones, fax machines, desk and lap top computers, to name a few, which products have proliferated over the last couple of decades and have become common place in our society. Such equipment or devices may have hundreds or even thousands of electrical connections that must be made between electronic circuit boards, bus wiring, wiring harnesses and input and output ports to provide the electrical connector pathways or highways needed to transport electrical signals needed for the electronic circuitry. The art of electrical connectors and contacts is very old and hundreds of different connectors have evolved throughout the last century. A few examples of connectors designed, in particular, to meet the needs of modern electronics are disclosed in U.S. Pat. No. 5,492,489 entitled "Four Way Audio Cable Adapter" to Chavakula (1996); U.S. Pat. No. 3,149,899 entitled "Electrical Contact Element" to Johanson (1962); U.S. Pat. No. 3,832,498 entitled "Aapter Enabling Telephone Switching Equipment Terminals To Be Wire Wrapped" to Lawson (1974); U.S. Pat. No. 4,090,771 entitled "Contact Assembly With Rotational Lock For Wire Wrap Termination" issued to Moulin (1978); U.S. Pat. No. 5,387,138 entitled "Printed Circuit Connector Apparatus and Method for Making the Same" to O'Malley (1995); U.S. Pat. No. 5,106,328 entitled "Contact Pin And Bushing Assembly" to Prochaska et al. (1992), and U.S. Pat. No. 5,439,391 entitled "Lead Adapter" to McEtchin et al. (1995).

Today with electrical component shrinking to unprecedented miniature sizes, connectors have followed suit and much effort is being placed in the area of connector technology to develop small scale connectors in mass quantities necessary to reliably make the many connections needed for densely populated electronic environments. In particular, pin and socket type connectors have gained popularity in the electronics industry and much effort has been made to make an improved pin/socket contacts. Such pin/socket contacts are very versatile and come in different configurations for connection to wires, circuit boards etc. For example, conventional pin/socket contacts typically have connection arrangements known in the industry as "tails" which take various shapes for use in a variety of circumstances such as square tails for wire wrapping, round tails for coupling to circuit board, or compliant tails for direct circuit board connections. Typically, the contacts are made of one piece. Therefore, for each particular size of pin or socket three separate contacts would be required to accommodate the three popular tail configurations, i.e., square, round and compliant. As a result, manufacturers or contact suppliers need to inventory a large number of contacts to satisfy the needs of customers requiring different tail configurations. In addition, there is the element of time to configure automatic screw machines to make the several different configurations.

The prior art has disclosed several two piece contact arrangements. However, such two piece contacts have not proven to be satisfactory for a number of reasons including material and manufacturing costs.

For example, U.S. Pat. No. 3,569,918 entitled "Multipiece Electrical Contact" to Arnold (1971) shows a contact having an cylindrically shaped insulating sleeve with a hole therethrough, one end to the insulator receiving a pin and the other end receiving a conductor. The sleeve accordingly provides the vehicle to couple the two metal contact portions together. Tails have also been coupled to a pin/socket contact by screwing the two together as illustrated in U.S. Pat. No. 3,210,720 entitled "Cable Connectors" to Harris (1961) which discloses a connector for use with high duty electrical cable, such cable being formed of one or more conductors, each of which embodies a plurality or strands, sheathed with filler strips and ground wires. The connector attached to the cable may be either a male member or a female member which in either case include a similar cylindrical section having at one end, a blind bore for receiving the end of the high duty electrical cable and at the other end provided with screw threads to threadably receive the corresponding threaded shank of either the female adapter of the male adapter, as the case may be. While this arrangement may be satisfactory for contacts that are not needed in mass quantities, it is not desirable for the vast array consumer electronics where quantities and cost are important factors.

Another example of a pin contact is illustrated in U.S. Pat. No. 5,399,110 entitled "Two Piece Male Terminal" to Morello et al. (1995) which includes a pin contact member and an attachment member which will ultimately receive a conventional insulated copper wire. The pin contact has a clamping portion at the rear end thereof, which clamping portion is swaged to define a post extending radially outwardly of the outer surface of the clamping portion. The attachment member has a slot which receives the post which is rolled onto the clamping portion. The post is coined to define a flange which engages the attachment member at locations surrounding the slot to securely retain the attachment member to the contact member. This arrangement requires a considerable amount of mechanical manipulation and is therefore undesirable where small size, cost and quantities are important. There is still a need for a pin/socket contact that is simple and inexpensive to manufacture, yet reliable in performance.

SUMMARY OF THE INVENTION

The foregoing mentioned disadvantages are avoided by a contact made of two assembled contact members. A first contact (or attachment) member has a tail at one end for connection to a wire, a circuit board, etc. and a stub portion at the other end, preferably, having one or more burrs, barbs or protrusions radially extending therefrom. The second (or pin/socket) member has two ends with a elongated axially extending, or hole blind cavity cylindrical or polygon in shape at one end and a conventional pin or socket arrangement at the other end. The stub portion is inserted into the blind cavity, the cavity being preferably sized to establish an interference fit between the cavity and the stub portion such that the stub portion is held securely in the cavity. The second member may be and preferably is crimped so that the inner surface of the cavity is deformed to capture the stub portion. While the tail of the first contact member can take a variety of configurations, i.e., square, round, complaint etc., to meet the needs of a particular industrial application, the second contact member can be standardized as a conventional socket or pin contact and made in large quantities being suitably adaptable for mating with the variety of attachment or tail configurations.

In preferred embodiments, the burr or protrusion on the stub portion may be cylindrically shaped, diamond shaped or flat, etc. Each such arrangement having suitably shaped burrs, protrusions or projections extending radially therefrom. The burrs or projections preferably have a squared edge or corner at the rearward side thereof for digging into the wall of the blind bore when a force is exerted tending to pull the attachment member's stub out of the second member's blind bore.

The construction and operation of preferred embodiments of the two piece contact of the present invention may best be understood by reference to the following description taken in conjunction with the accompanying drawings in which like components are designated by the same primed reference numbers.

DESCRIPTION OF THE PREFERRED EMBODIMENT

Figure 1:
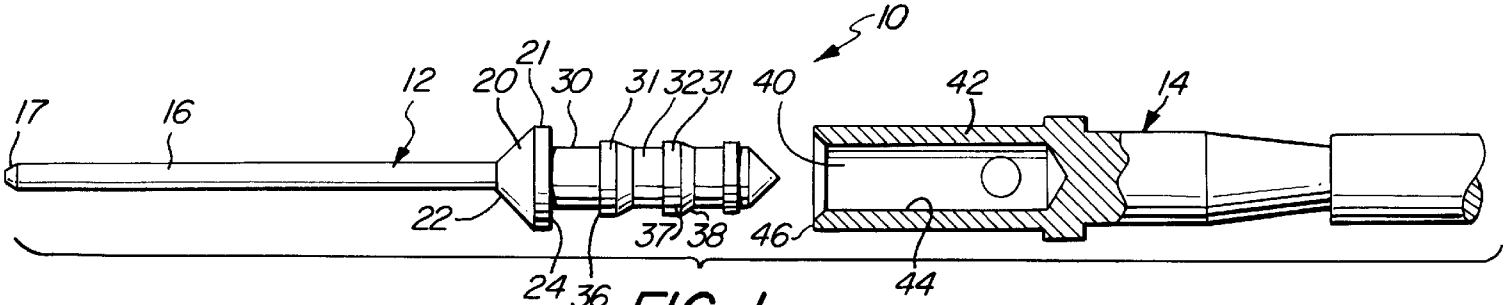
FIG. 1 is a side view of a contact in accordance with the principles of the invention illustrating the two contact parts prior to assembly.

Referring now to the drawings and more particularity to FIG. 1, there is shown a contact 10 having a two part construction including a first or attachment member 12 and a second or pin/socket member 14. The first member 12, which is made of an electrically conductive material such as brass, has a round or cylindrically shaped solid tail 16 along its rearward portion, which is also known in the industry as a PC tail. The tail 16 has a round point 17 at its rearward end and, which facilitates insertion of the PC tail into a printed wiring board connector socket. The attachment member 12 further, at a medial portion, has an integral collar 20, which is generally cylindrically shaped. The collar has a front face 22 which slopes rearwardly from the outer extent of the collar to the diameter of the tail. The collar further has a radially extending abutment surface 24 at its forward side which surface is perpendicular to the axis of the tail 16.

At its forward end, the first or attachment member 12 has a stub portion, generally designated by reference number 30, which extends forwardly from the abutment surface 24. While the stub portion may have a variety of configurations, in this description of the preferred embodiments, the stub portion is formed of a cylindrical member 32 which is collinear with the tail 16. The cylindrical member preferably has a plurality of radially extending burrs or protrusions 34 in the form of ridges, which ridges extend circumferentially around the cylindrical member 32 essentially perpendicular to the axis of the tail 16 and cylindrical member 32. The ridges 34 may have a generally rectangular cross-section with a square corner 36 at the rearward end, an intermediate outer surface 37 and a sloping inward edge 38 at the forward section tapering from a diameter equal the ridge intermediate outer surface 37 and whose forward diameter tapers so as to equal the diameter of the cylindrical stub portion.

The second (or pin/socket) contact member 14 of the contact 10 is cylindrically shaped and made of an electrically conductive material such as brass. The rearward end of the member 14 has a blind cavity or hole in the form of a cylindrical opening or bore 40 which is formed along the axis of the attachment member 12 and is sized and shaped to receive the stub portion 30 of the contact member 12. The bore 40 is formed from a cylindrical wall 42 which has an inner cylindrically shaped wall surface 44 and also an annular shoulder 46 disposed essentially perpendicularly to the axis of the attachment member 14. In the preferred embodiment, the size of the bore 40 is pre-selected to be less than the extent of the burrs and in particular the outer extent of the ridge intermediate outer surface 37 so that an interference fit is formed when the two contact members are joined.

Figure 2:
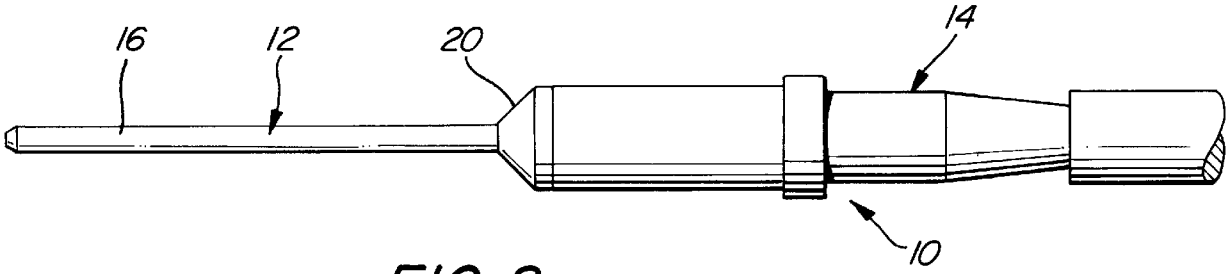
FIG. 2 is a side view of the contact in FIG. 1 in assembled condition.
Figure 3:
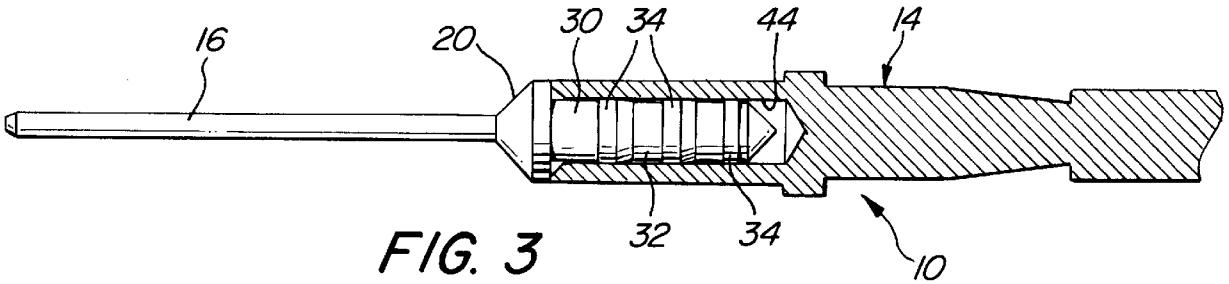
FIG. 3 is a cross-sectional side view of the assembled contact in FIG. 2.

Accordingly, as can be readily seen in FIGS. 2 and 3, when the first contact member 12 is assembled with the second member 14, with the stub portion 30, extending into the blind bore 40, the radially extending abutment surface 24 at the rearward side of the collar 20 abuts the annular shoulder 46 of the attachment member 14. The burrs or ridges 34 on the cylindrical member 32 form a tight fit or interference fit with the inner wall surface 44 of the blind bore 40, as is shown with more particularity in FIG. 3. The interference fit formed between the stub and bore wall inhibits any rearward movement of the first member relative to the second member and thus holds the two members 12 and 14 securely together.

Figure 4:
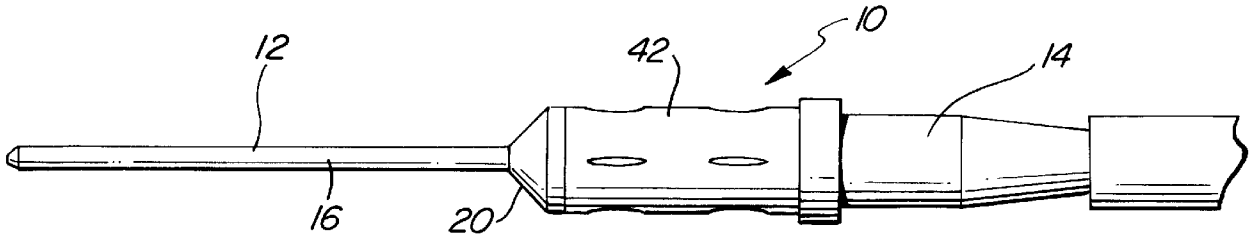
FIG. 4 is a side view of the contact of FIG. 2 after crimping.
Figure 5:
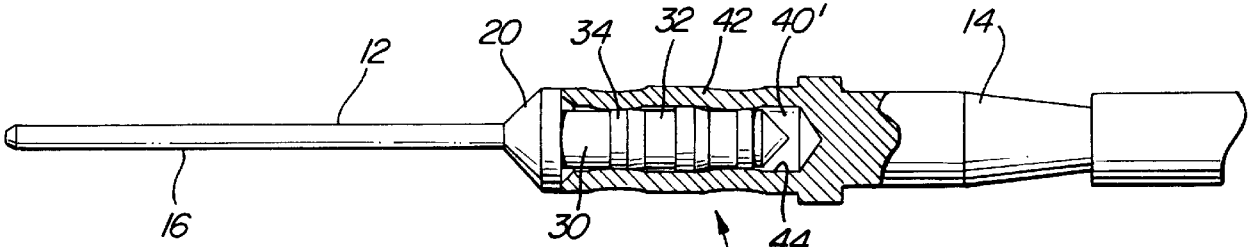
FIG. 5 is a cross-sectional side view of the assembled contact in FIG. 4.

In the event that the bore 44 is not sized to provide an interference fit or if a more secure fit is desired when an interference fit is provided, the cylindrical wall 42 of the attachment member 14 is roll crimped to compress the wall reducing the diameter of the wall with respect to the ridges, as is shown with more particularity in FIGS. 4 and 5. In this embodiment, two sections of the cylindrical wall 42 are indented over selected portion of the stub and the ridges. Crimping tools and processes well known in the art may be employed to accomplish the wall compression. This crimping further prevents axial movement of the stub within the blind bore. The forward end of the second contact member 14 forms a conventional pin or socket contact (not shown in FIGS. 1–3).

Figures 6, 7, 9, 10, 11, 12:
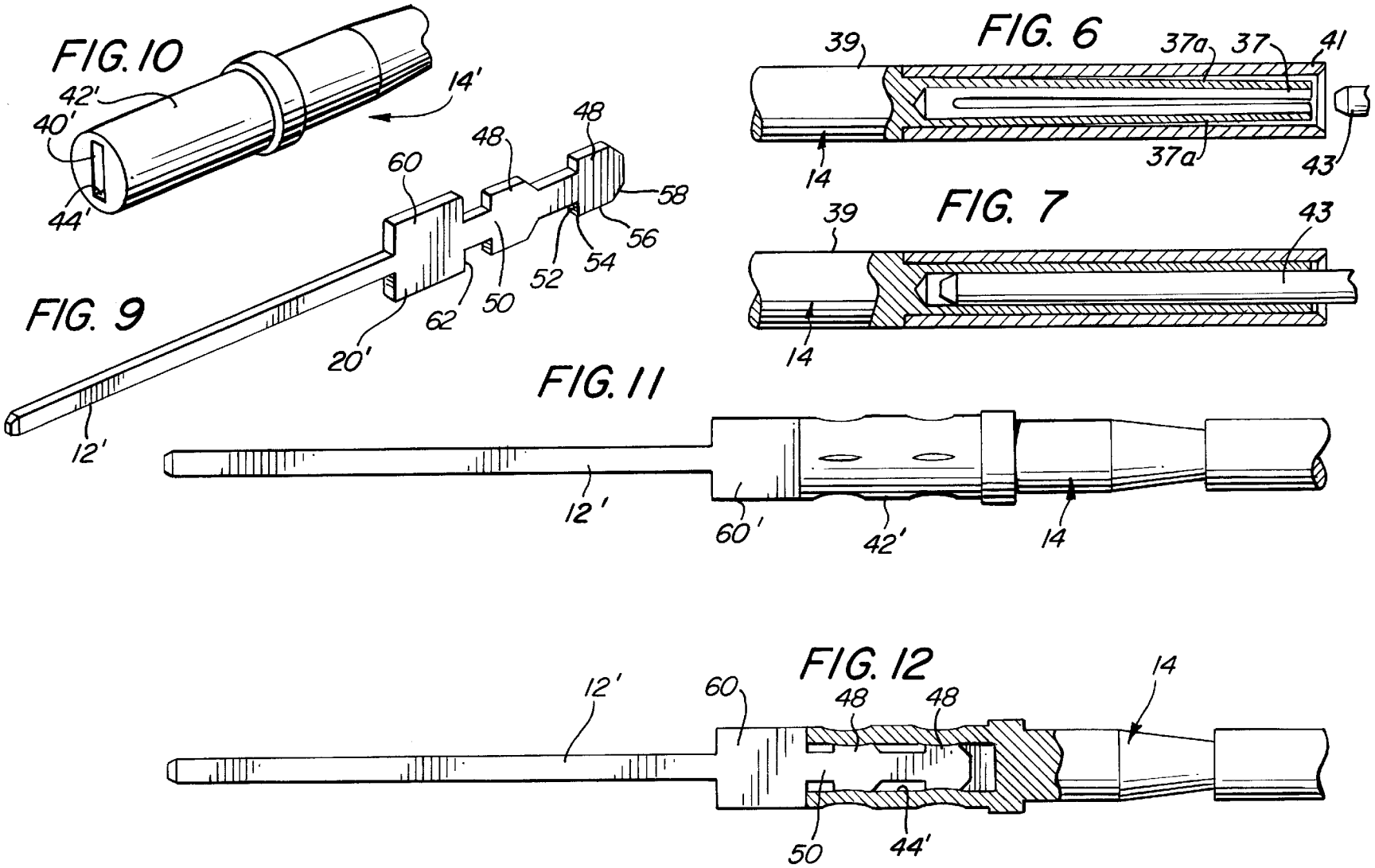
FIG. 6 is a cross-sectional view of a conventional socket which may be formed on the forward end of the second contact part of FIGS. 1–3.
FIG. 7 is a cross-sectional view of the socket end shown in FIG. 6 with a male pin inserted therein, which pin may be formed on the forward end of the second contact part of FIGS. 1–3 in lieu of the socket.
FIG. 9 is a perspective view of the first contact part of FIG. 8 showing the stub portion more clearly.
FIG. 10 is a partial perspective view of the second contact part of FIG. 8 showing the cavity.
FIG. 11 is a side view of the assembled contact of FIG. 8 after crimping.
FIG. 12 is a cross-sectional side view of the assembled contact of FIG. 8, and FIGS. 13A through E are perspective views of other first contact part configurations.
Figure 13A:
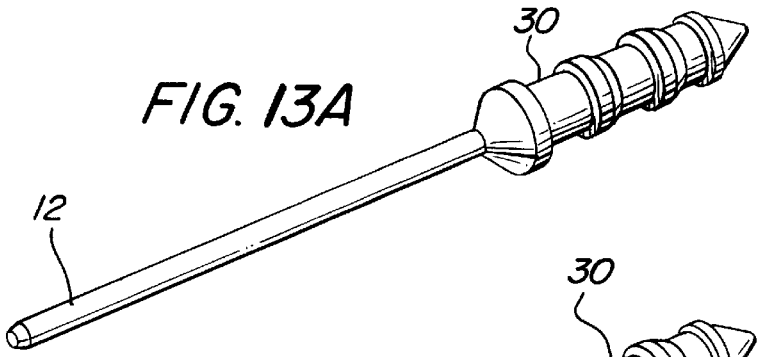
Figure 13B:
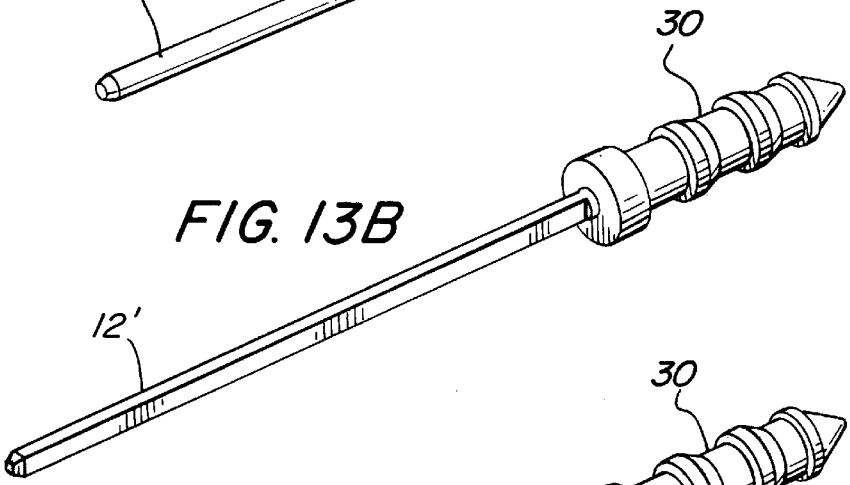
Figure 13C:
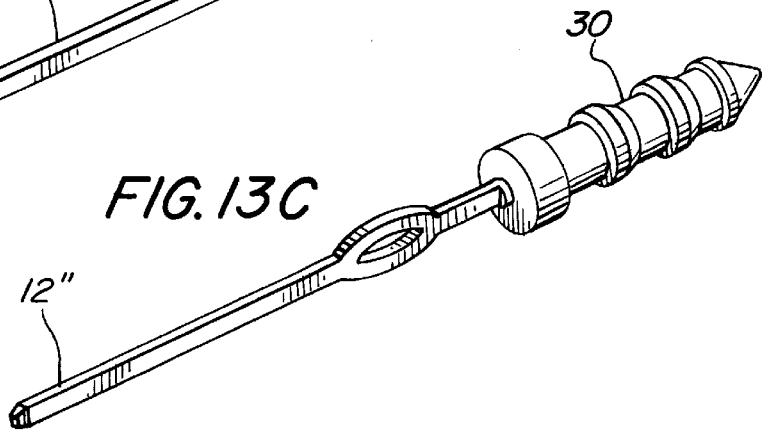
Figure 13D:
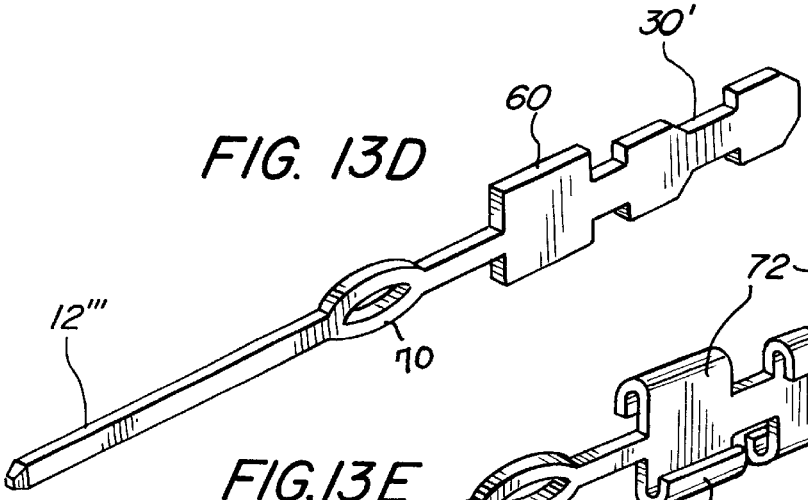
Figure 13E:
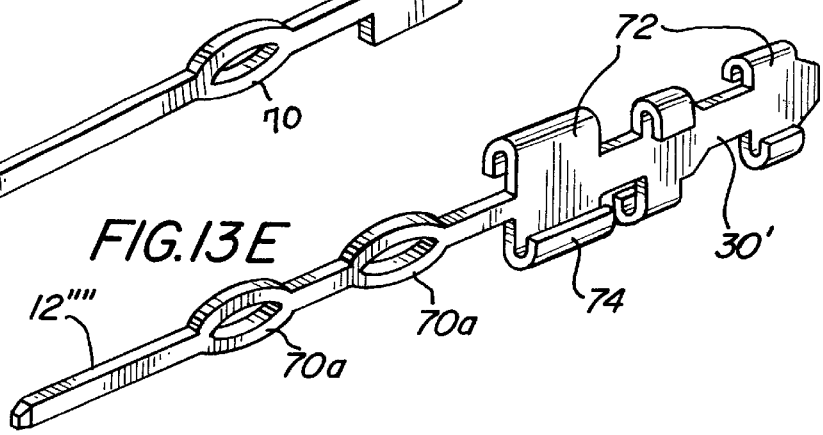

FIGS. 6 and 7 illustrate conventional socket and pin contact arrangements which may form the forward section of the second or pin/socket member 14. A conventional socket terminal 37, segmented to form tines 37*a* is formed on the forward end 39 of the second contact member 14. A sleeve 41, which may be made of steel, for example, surrounds the socket terminal 37. Alternatively, pin terminal 43, shown in FIG. 7, may be formed on the forward end of the second contact member.

Figure 8:
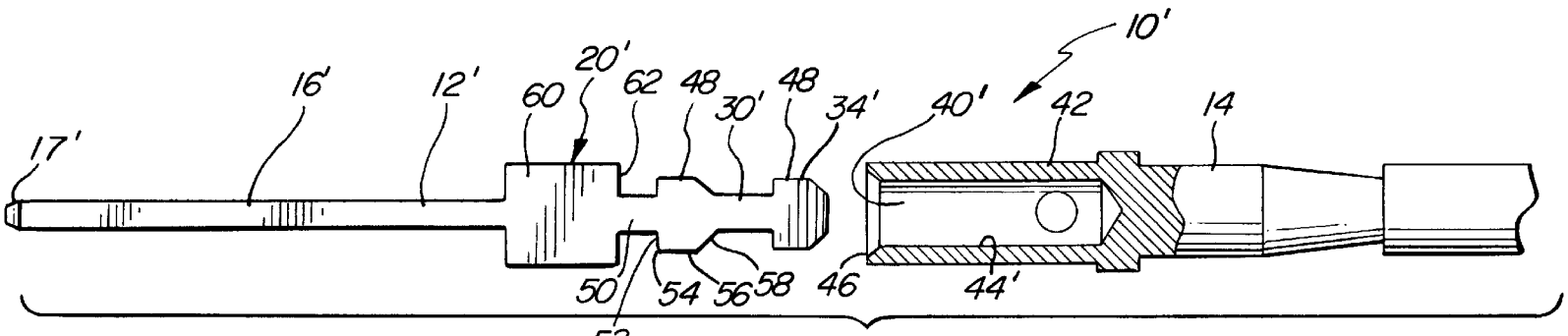
FIG. 8 is a side view of another preferred embodiment of a contact illustrating the two contact parts prior to assembly.

In another preferred embodiment illustrated in reference to FIG. 8, the first contact member has a rectangular shaped solid pin 16' along its rearward portion, which is also known in the industry as a wire wrap tail. The tail 16' has a triangular point 171 at its rearward end, which facilitates insertion of a wire wrap tool over the tail for wrapping an electrical wire onto the tail. The stub portion 30' of the contact member 12' is formed of an essentially flat member 50 to provide a polygon shape and extends forwardly along the same axis of tail 16'. Flat member 50 has a plurality of burrs or protrusions 34' in the form of rectangularly shaped barbs 48', which have a rearward flat upstanding side 52 terminating in an upper corner 54, a flat top 56, and a sloping front side 58, as shown in more particularity in reference to FIG. 9. In this example, four barbs 48 are shown in two oppositely disposed pairs. The first contact member 12 further, at a medial portion, has an integral collar 20', which is a flat rectangular portion 60 that is co-planar with the flat member 50. The collar further has an upstanding abutment surface 62 at its forward side which surface is perpendicular to the axis of the tail 16'.

Referring to FIG. 10, the blind cavity or hole 40' in the second contact member 42' is shown as having a polygon or rectangular shape to more clearly match the configuration of the stub portion 30' of the first contact member. It should be noted that the cavity in the second contact member for receiving a flat stub portion like 30' may be cylindrical. However, a cavity which more closely matches the configuration of the stub portion will generally have better retention properties. It should also be noted that while the stub portion 20' of the first contact member 12' (FIG. 9) is shown as having a rectangular shape, it could be formed in a triangular or other polygon shape.

Referring to FIGS. 11 and 12, the two piece contact 10' (FIG. 8) is assembled with the flat portion 50 of the first contact member 12' extending into a cavity 40 of the second contact member 14 with the upstanding abutment surface 62 at the forward side of the collar 20' abutting the annular shoulder 46 of the second contact member 14. The cavity 40' may have a inner wall 44' which is smaller than the lateral extent of the barbs 48 such that the barbs form a tight fit with the inner wall 44 of the second contact member 14. Alternatively, as shown with more particularity with reference to FIG. 12, the wall 42' of the second contact member 14' may be roll crimped thereby tightening the wall over the barbs 48 to secure the stub with the bore. In the case where the tail is square for wire wrapping purposes the crimp provides additional resistance to prevent axial and rotational motion of the first contact member with respect to the second contact member.

There has thus been described an improved two piece pin/socket contact which can be reliably assembled on a repetitive basis while saving manufacturing costs. Large quantities of pin/socket contacts can be readily and quickly assembled with any particular tail configuration to suit a customer's needs. Thus, large customer demands for product can be met more quickly and more reliably. Advantageously, one pin or socket member 14 can be used with a variety of tail and stub configurations, such as those referenced by reference numbers 12, 12', 12" and 12'" which, as shown in FIGS. 13A through E, may have a cylindrical or PC tail, a square or rectangular tail for accommodating a wire wrap connection or a wire wrap, compliant adapter 70 or other configurations. The first contact member 12"" is shown as having a double compliant adapter 70*a* and a flat sub portion 30'. The stub portion 30' includes radially extending barbs 72 having U-shaped end sections 74 to form outer curved sections 76. Such curved sections will facilitate the insertion of the first contact member 12"" into a cylindrical cavity in a second contact member. The second contact members (i.e., conventional pin or socket configurations) can be inventoried in mass quantities being suitable to meet a variety of customer demands. Accordingly, various modifications of the two piece contact arrangement, and processes involved in manufacturing the contact will occur to persons skilled in the art without involving any departure from the spirit and scope of the invention as set forth in the appended claims.

What is claimed is:

1. A two piece pin/socket contact, comprising:

a first member having a tail end and a forwardly extending stub portion, the stub portion having at least one radially extending protrusion thereon, and a second member having a blind bore at the rearward end thereof and a pin or socket at the forward end thereof, the stub portion slidably inserted into the blind bore, the blind bore being sized to establish an interference fit between the bore and the protrusion such that the stub portion is held securely in the bore.

2. The invention of claim 1 wherein the cavity is in the form of a cylindrical opening and the stub portion is cylindrically shaped.

3. The invention of claim 2 wherein the protrusion on the stub portion comprises a ridge circumscribing the stub portion.

4. The invention of claim 3 wherein the ridge includes a rectangularly shaped section.

5. The invention of claim 4 wherein the rectangularly shaped ridge section has a square shaped corner facing the tail end of the first member and a downwardly sloping corner extending forwardly of the square shaped corner.

6. The invention of claim 4 wherein the second member is crimped to close the cylindrical opening over the protrusion.

7. The invention of claim 1 wherein the stub portion of the first member has a polygon shape.

8. The invention of claim 7 wherein the stub portion is essentially flat.

9. The invention of claim 8 wherein the second member is crimped to close the cavity over the protrusion.

10. The invention of claim 8 wherein the protrusion is co-planar with the essentially flat stub.

11. The invention of claim 10 wherein the protrusion is essentially rectangularly shaped.

12. The invention of claim 10 wherein the cavity is in the form of a blind bore with an inner cylindrical wall and wherein the protrusion is essentially flat with U-shaped terminal edges providing a curved surface for engaging the inner wall of the blind bore.

13. A method for making a connector pin/socket contact, comprising the steps of:

providing a first member having a rearwardly extending tail and a forwardly extending stub a stub with at least one radially extending burr thereon;

providing a second member with a standardized pin/socket in the front portion thereof, the rear portion defining an elongated axially extending blind hole, the inner wall of which is sized and shaped to receive the stub of the first member, and pressing the stub into the hole wherein the burr forms an interference fit within the hole; and crimping the second member adjacent the rear portion hole thereof to close the inner wall of the hole around the burr.

14. The method defined in claim 13 wherein the stub of the first member is formed in the shape of a cylindrical post and the blind cavity in the second member is formed in the shape of a cylindrical opening.

15. The method defined in claim 13 wherein the burr has a generally rectangular shape.

16. The method of claim 13 wherein the stub of the first member is formed in the shape of a polygon.

17. The method of claim 16 wherein the blind cavity in the second member is formed with an inner wall in the shape of a polygon which matches the shape of the stub.

18. The method of claim 17 wherein the inner wall of the blind cavity has a rectangular opening.

19. A two piece pin/socket contact comprising:

a front member defining a standardized pin or socket on the forward end thereof and an elongated axially extending blind hole on the rearward end, the hole having an inner wall;

a rear member having a rear tail portion and a front stub portion positioned in the hole to form an interference fit; and the front member being roll crimped to deform the inner wall of the hole and the stub portion of the rear member to retain the stub portion within the hole.

20. The two piece pin/socket contact of claim 19 wherein the stub includes a generally polygonal shaped burr which engages the inner wall of the cavity.

21. The two piece pin/socket contact of claim 20 wherein the burr extends substantially radially outwardly from the surface of the stub portion.

22. The two piece pin/socket contact of claim 21 wherein the burr is rectangularly shaped defining a corner and squared edge which digs into the cavity wall and thereby resist removal and rotation of the rear member relative to the front member.

23. The connector of claim 19 wherein the rear member further has an integral collar for limiting the insertion of the stub portion into the cavity.

24. The two piece contact of claim 23 wherein the collar of the rear portion has a tapered forward end portion and a flat rear section for abutting the front member.

25. The two piece contact of claim 19 wherein the stub is in the form of a cylindrical post and the cavity is in the form of a blind bore.

26. The two piece contact of claim 25 wherein the post has radially extending protrusions formed thereon.

* * * * *

UNITED STATES PATENT AND TRADEMARK OFFICE

CERTIFICATE OF CORRECTION

PATENT NO. : 6,004,172
DATED : December 21, 1999
INVENTOR(S) : Leslie Laszlo Kerek It is certified that error appears in the above-indentified patent and that said Letters Patent is hereby corrected as shown below:

Column 2, line 55, "extending, or hole blind cavity" should read --extending blind cavity or hole,--

Column 5, line 12, "171" should read --17'--.

Column 6, line 6, "30'" (both occurences) should read --30''--.

Signed and Sealed this

Seventeenth Day of October, 2000

*Attest:*

Q. TODD DICKINSON

*Attesting Officer*

*Director of Patents and Trademarks*